US005249564A

United States Patent [19]

Peachey

[11] Patent Number: 5,249,564

[45] Date of Patent: Oct. 5, 1993

[54] SOCCER BALL PROJECTING APPARATUS

[76] Inventor: John E. Peachey, 25954 State Rd. 19, Arcadia, Ind. 46030

[21] Appl. No.: 818,107

[22] Filed: Jan. 8, 1992

[51] Int. Cl.[5] ..... F41B 3/02

[52] U.S. Cl. ..... 124/17; 124/41.1; 124/81

[58] Field of Search ..... 124/16, 17, 20.1, 20.3, 124/41.1, 81, 1

[56] References Cited

U.S. PATENT DOCUMENTS

| | | | |
|---|---|---|---|
| 300,415 | 6/1884 | Van Allen | 124/17 X |
| 2,282,315 | 5/1942 | Adams | 124/17 |
| 2,823,483 | 2/1958 | Malott | 124/20.1 X |
| 3,428,318 | 2/1969 | Vick | 124/20.1 X |
| 3,802,409 | 4/1974 | Mike et al. | 124/20.1 |
| 4,240,396 | 12/1980 | Randoll | 124/17 |
| 4,345,577 | 8/1982 | Andersson | 273/411 X |
| 4,352,348 | 10/1982 | Griffith | 273/411 X |
| 4,722,316 | 2/1988 | Stinnett et al. | 124/16 X |
| 4,922,884 | 5/1990 | Ford | 124/20.1 |
| 5,127,389 | 7/1992 | Magnuson | 124/17 |

FOREIGN PATENT DOCUMENTS

| | | | |
|---|---|---|---|
| 21301 | 3/1883 | Fed. Rep. of Germany | 124/17 |
| 9102938 | 3/1991 | PCT Int'l Appl. | 124/17 |
| 654816 | 6/1951 | United Kingdom . | |
| 665518 | 1/1952 | United Kingdom | 124/17 |
| 2137517 | 10/1984 | United Kingdom | 124/20.1 |

*Primary Examiner*—Randolph A. Reese
*Assistant Examiner*—Harry C. Kim
*Attorney, Agent, or Firm*—Locke Reynolds

[57] ABSTRACT

An apparatus for projecting a soccer ball includes a generally horizontal base and a frame extending upwardly from the base including a pair of spaced apart vertical memebers. Each vertical member has a plurality of vertically spaced attachment locations. A sling including a pouch for receiving a ball is attached to a selected set of the attachment locations. A set of elongated elastomeric members are attached to a selected set of the attachment locations for supporting the pouch in the frame. The pouch is constructed of a flacid conformable sheet bounded by a perimeter and has an inner surface including frictionally engaging ribs for engaging the ball sufficiently to impart a spin on the ball upon the ball's projection therefrom. An H-shaped handle is fixed to the pouch perimeter at a plurality of points for imparting a ball-projecting pull on the sling.

6 Claims, 2 Drawing Sheets

SOCCER BALL PROJECTING APPARATUS

BACKGROUND OF THE INVENTION

This invention relates generally to apparatus for projecting a ball, particularly a soccer ball, in a predictable manner for the purpose of helping ball players improve their skills.

The sport of soccer calls on a player to utilize the feet, and body, including the chest, head, shoulder, etc., to control a ball. That ball may be delivered to the player on occasion by a throw-in, but more often from a kick or pass in which the ball may be spinning rapidly causing it to follow a curved path trajectory. Mastery of a ball experiencing such a trajectory whether for the purpose of trapping, touch passing, shooting or clearing, requires a significant amount of practice and experience. An apparatus has long been sought to provide reliable, repeatable experience for the players so as to permit them to acquire important skills in a minimum amount of time.

A number of apparatus have been designed with the intent to provide for such experiences. Recent examples are to be found in U.S. Pat. Nos. 4,345,577 and 4,352,348. The apparatus disclosed in these patents and other similar apparatus have employed motorized devices to impart reasonably repeatable impulses onto a soccer ball thereby permitting players to repeatedly react to a similar type of impulse delivered to a number of balls. Since the devices are motorized, they typically require the availability of a source of electric power, a motorized generator or some other power source. Typically such devices have been designed to operate at a level compatible with honing the skills of collegiate level and better players. The apparatus is typically not capable of being slowed sufficiently to project a ball to a young elementary school player at a speed slow enough to permit him to gain confidence in his own basic soccer skills.

Some non-motorized devices intended to toss a ball are shown in U.S. Pat. No. 300,415 and British Patent 654,816. Both devices employ a generally horizontal base and a frame extending upward from the base which includes a pair of spaced apart members placed in a fixed relationship with respect to the horizontal base. A ball holder is coupled to the vertical members by elastic straps in the general form of a projecting sling. By varying the amount and direction of pull on the sling, a ball can be delivered from the apparatus toward a selected position. However, experience with devices of this type has shown that the devices are incapable of consistently imparting the desired spin on the ball. This absence of spin causes the ball to float and jump in an unpredictable manner toward the player. While this unpredictable ball behavior may be is desirable on rare occasion, it does not permit one to reliably imitate the in-game experiences of in-swinging crosses, out-curving corner kicks and the like, needed to truly elevate the skills of young players.

It is therefore an object of the present invention to provide a soccer ball projecting apparatus capable of delivering a ball to any desired field position at a variety of velocities with controlled repeatable spin characteristics so as to permit players of all ages to experience game-like ball behavior.

SUMMARY OF THE INVENTION

An apparatus of the present invention which achieves this goal includes a generally horizontal base and a frame extending upward from the base including a pair of spaced apart members. Each member has a plurality of vertically spaced attachment locations to which is selectively attached a set of elongated elastomeric members coupled to a ball receiving pouch. The pouch comprises a flacid conformable sheet bounded by a perimeter having an inner surface including means for frictionally engaging the ball sufficiently to impart a spin on the ball upon the projection of the ball from the apparatus. Handle means are fixed to this sheet perimeter at a plurality of points for imparting selected ball-projecting pulls on the sling.

The perimeter of the flacid conformable sheet preferably comprises a rectangle with the elongated elastomeric members being connected to the corners of the rectangle. A pair of side defining members in the form of elastic straps are coupled to the sides of the rectangular perimeter. Preferably the side members are in the form of an elastic strap having an unstretched length less than the distance measured along the sheet perimeter between the points of attachment of the side defining member.

The means frictionally engaging the surface of the ball preferably comprises a pattern of ribs on the sheet inside surface for enhancing the frictional engagement with the ball. Preferably the pattern of ribs consists essentially of neoprene but could be formed of other polymers which would exhibit a sufficiently high coefficient of friction with the ball to repeatedly impart the desired spin characteristics.

The handle means preferably comprises a plurality of straps having ends fixed to the pouch perimeter in the form of a generally H-shaped member. The H-shaped member is made up of a pair of straps, each strap having both ends fixed to the pouch perimeter. A shorter web member joins the pair of straps at their mid-point so as to form strap halves between the web member and the pouch perimeter. The web member and each strap half has a length sufficient to be grasped to impart the selected pull on the sling. By grasping one or more of the selected handle portions, a wide variety of spins and trajectories can be imparted to the ball.

The various features and advantages of a ball projecting apparatus in accordance with the present invention will become apparent to those skilled in the art upon consideration of the following description of a preferred embodiment exemplifying the best mode of carrying out the invention as presently perceived. The detailed description particularly refers to the accompanying drawings.

DESCRIPTION OF THE PREFERRED EMBODIMENT

Figure 1:
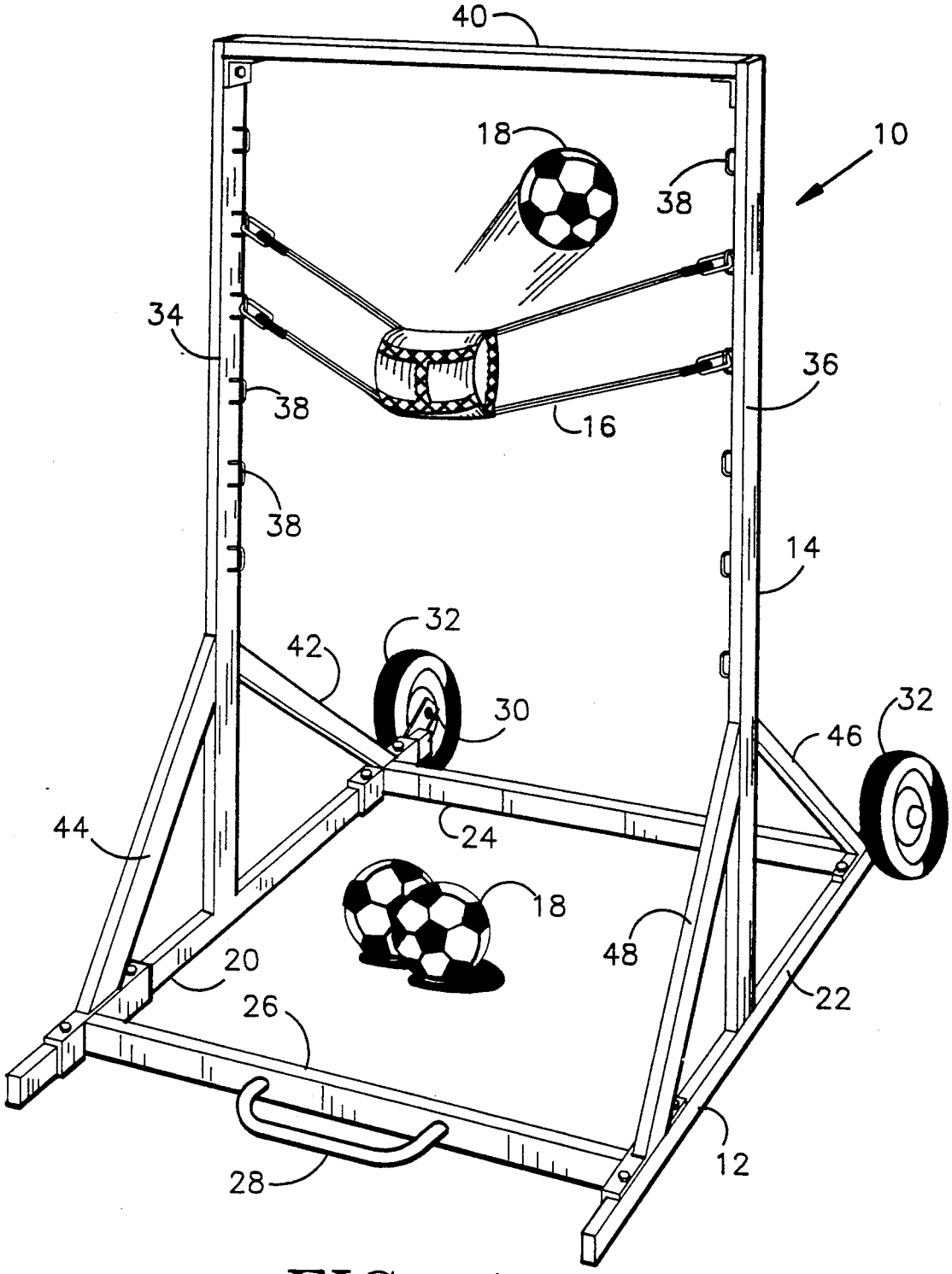
FIG. 1 is a perspective view of a ball projecting apparatus in accordance with the present invention.

A ball projecting apparatus 10 comprises generally of horizontal base 12, a frame 14 extending upwardly from the base 12, and a sling 16 suspended in the frame for the projection of soccer ball 18. The horizontal base 12 comprises a pair of side base bars 20 and 22 which are about 2 meters in length. The two side base bars are separated from each other by a front base bar 24 and a back base bar 26 which are also about 2 meters in length. The back base bar 26 includes a handle 28 welded on the back side of the center of the base bar 26. Each of the side base bars 20 and 22 includes at the front end a vertically extending plate 30 having a hole drilled at a top end thereof to receive an axle of wheel 32.

The vertical frame 14 comprises a pair of uniformly spaced apart members 34 and 36 which rise perpendicularly from the mid-point of side rails 20 and 22, respectively. Each of the upwardly extending members 34 and 36 are preferably about 2.7 meters in length and include a plurality of rungs 38 welded onto the inside of the members. The tops of the vertically extending members 34 and 36 are joined by spacer bar 40 having a length dimension substantially identical to the front and rear base members 24 and 26. Four support bars 42, 44, 46 and 48 extend diagonally between a point on the upright members 34 and 36 below the lower most rung 38 and the junction of the side members 20 and 22 with the spacing members 24 and 26.

Figure 2:
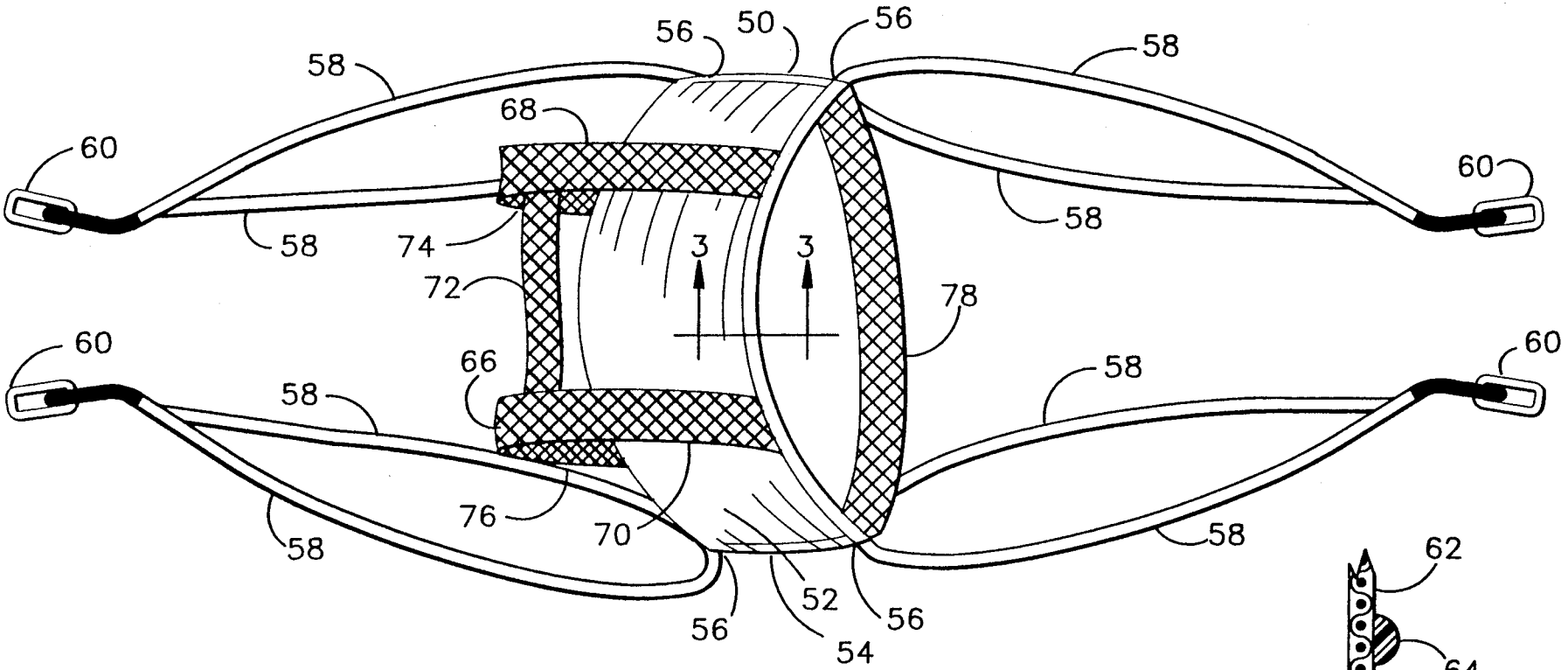
FIG. 2 is a detailed view of a sling for use in the apparatus shown in FIG. 1.

The sling 16 is shown in greater detail in FIG. 2 to comprise a ball receiving portion or pouch 50 which generally comprises a flacid conformable sheet 52 having a rectangular perimeter 54 including four corners 56. Attached to each of the four corners 56 are a pair of elastomeric members 58 such as 1 centimeter diameter bunge cord, which in relaxed condition is preferably about 1 meter in length as measured between a corner 56 and a gated clip such as a carabinier 60. The gated clips 60 provide for easy releasable attachment to any of the selected attachment rungs 38 which may be desired.

The sling 16 also includes a handle means 66 which is shown in FIG. 2 to comprise a pair of horizontal straps 68 and 70. Each of the straps 68 and 70 have opposite ends joined to the perimeter 54 and pouch 50 so that the handle means 66 extends away from the back surface of the pouch 50. A web member 72 joins the two mid-points 74 and 76 together at a fixed distance from each other and effectively divides each of the straps 68 and 70 into strap halves existing between the web member 72 and the pouch perimeter 54. The web member 72 and each strap half preferably has a length of between about 15 and 20 centimeters to permit each portion of the handle to be grasped in one or two hands to impart a particularly desired backward pull on the sling 16.

A pair of side members 78 are provided, one on each side of sheet 50, with both ends of each side defining member 78 being joined to a single side of the rectangular perimeter 54. The side defining member preferably comprises an elastic strap having an unstretched length less than the length of the side of the sheet 50 to which it is attached. The rectangular dimensions of sheet 50 which has been found to be suitable for the intended purpose are about 35 centimeters by 25 centimeters. The length of the side defining member 78 in the unstretched condition are about 20 centimeters.

Figure 3:
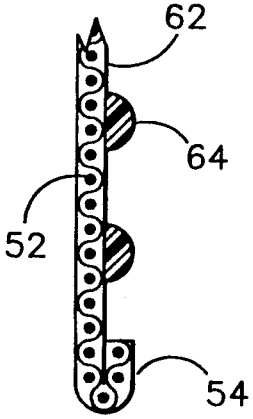
FIG. 3 is a sectional detailed view of the pouch taken along line 3—3 of FIG. 2.

The sheet forming the pouch is preferably made of fiber reinforced neoprine as shown in FIG. 3. The pouch further includes on the forward surface 62 means for frictionally engaging the ball sufficiently to impart a spin on the ball upon the ball's projection from the sling. The frictional means 64 are preferably in the form of a regular pattern of ribs on the sheet surface 62 formed of neoprine as shown in FIG. 3.

Although the invention has been described in detail with reference to the illustrated embodiment, variations and modifications exist within the scope and spirit of the invention as described and as defined in the following claims.

What is claimed is:

1. An apparatus for projecting a ball comprising a generally horizontal base, a frame extending upwardly from the base including a pair of spaced apart members, each said member having a plurality of vertically spaced attachment locations, and a sling including a pouch for receiving a ball to be projected and a set of elongated elastomeric members attached to a selected set of the attachment locations for supporting the pouch in the frame, the pouch comprising a flaccid conformable sheet bounded by a rectangular perimeter, with the elongated elastomeric members being connected to corners of the rectangular perimeter, the conformable sheet having an inner surface including means for frictionally engaging the ball sufficiently to impart a spin on the ball upon the ball's projection therefrom, and handle means fixed to the sheet perimeter at a plurality of points for imparting a ball-projecting pull on sling side defining members, each said side defining member having ends attached at two points on a single side of the rectangular perimeter and wherein each said side defining member comprises an elastic strap having an unstretched length less than the distance measured along the sheet perimeter between the points of attachment of the side defining member to the sheet perimeter.

2. The apparatus of claim 1 wherein said means for frictionally engaging the ball comprises a pattern of ribs on the sheet inside surface for enhancing the frictional engagement with the ball.

3. The apparatus of claim 2 wherein the pattern of ribs consists essentially of neoprene.

4. The apparatus of claim 1 wherein the handle means comprises a plurality of straps having ends fixed to the sheet perimeter.

5. An apparatus for projecting a ball comprising a generally horizontal base, a frame extending upwardly from the base including a pair of spaced apart members, each said member having a plurality of vertically spaced attachments locations, and a sling including a pouch for receiving a ball to be projected and a set of elongated elastomeric members attached to a selected set of the attachment locations for supporting the pouch in the frame, the pouch comprising a flaccid conformable sheet bounded by a rectangular perimeter, with the elongated elastomeric members being connected to corners of the rectangular perimeter, the conformable sheet having an inner surface including means for frictionally engaging the ball sufficiently to impart a spin on the ball upon the ball's projection therefrom, and handle means fixed to the sheet perimeter at a plurality of points for imparting a ball-projecting pull on sling side defining members, each said side defining member having ends attached at two points on a single side of the rectangular perimeter and wherein each said side defining member comprises an elastic strap having an unstretched length less than the distance measured along the sheet perimeter between the points of attachment of the side defining member to the sheet perimeter, and wherein the handle means comprises a plurality of straps having ends fixed to the sheet perimeter, with the straps forming a generally H-shaped member having four points of attachment to the sheet perimeter.

6. An apparatus for projecting a ball comprising a generally horizontal base, a frame extending upwardly from the base including a pair of spaced apart members, each said member having a plurality of vertically spaced attachment locations, and a sling including a pouch for receiving a ball to be projected and a set of elongated elastomeric members attached to a selected set of the attachment locations for supporting the pouch in the frame, the pouch comprising a flaccid conformable sheet bounded by a rectangular perimeter, with the elongated elastomeric members being connected to corners of the rectangular perimeter, the conformable sheet having an inner surface including means for frictionally engaging the ball sufficiently to impart a spin on the ball upon the ball's projection therefrom, and handle means fixed to the sheet perimeter at a plurality of points for imparting a ball-projecting pull on sling side defining members, each said side defining member having ends attached at two points on a single side of the rectangular perimeter, and wherein each said side defining member comprises an elastic strap having an unstretched length less than the distance measured along the sheet perimeter between the points of attachment of the side defining member to the sheet perimeter, and wherein the handle means comprises a pair of straps, each said strap having ends fixed to the sheet perimeter, and a web member joining med-points of the pair of straps to form strap halves existing between the web member and the sheet perimeter, the web member and each said strap half having a length sufficient to be grasped to impart a selected pull on the sling.

* * * * *